US006109554A

United States Patent [19]

Kotzur et al.

[11] Patent Number: 6,109,554

[45] Date of Patent: Aug. 29, 2000

[54] COMBINED FIBER CONTAINERS AND PAYOUT TUBES AND PLASTIC PAYOUT TUBES

[75] Inventors: Frank W. Kotzur, Carmel; Aaron Harmon, Hopewll, both of N.Y.

[73] Assignee: Windings, Inc., Patterson, N.Y.

[21] Appl. No.: 09/157,317

[22] Filed: Sep. 21, 1998

[51] Int. Cl.[7] ..... B65H 55/02; B65H 57/12

[52] U.S. Cl. ..... 242/163; 242/171; 242/137.1; 242/157 R

[58] Field of Search ..... 242/163, 170, 242/171, 159, 137, 137.1, 138, 141, 146, 157 R; 206/395, 409

[56] References Cited

U.S. PATENT DOCUMENTS

| | | | |
|---|---|---|---|
| 2,738,145 | 3/1956 | Taylor | 242/163 |
| 2,943,732 | 7/1960 | Kovaleski et al. | 242/170 |
| 3,178,130 | 4/1965 | Taylor | 242/163 |
| 3,666,200 | 5/1972 | Newman et al. | 242/163 |
| 3,985,315 | 10/1976 | Newman . | |
| 4,022,399 | 5/1977 | Zajac . | |
| 4,057,203 | 11/1977 | Newman et al. . | |
| 4,274,607 | 6/1981 | Priest . | |
| 4,367,853 | 1/1983 | Kotzur . | |
| 4,373,687 | 2/1983 | Zicko | 242/163 |
| 4,523,723 | 6/1985 | Kotzur | 242/163 |
| 5,150,852 | 9/1992 | Hunt et al. | 242/163 |
| 5,470,026 | 11/1995 | Kotzur | 242/163 |
| 5,520,347 | 5/1996 | Bass et al. | 242/163 |

*Primary Examiner*—John M. Jillions
*Attorney, Agent, or Firm*—Laubscher & Laubscher; R. J. Lasker, Esq.

[57] ABSTRACT

A payout tube for insertion in a radial hole of a wound coil of filamentary material and extending from the inner to the outer wind of said wound coil, comprising:

an entrance opening and an exit opening in coaxial and spaced relationship with one another;

the size of said entrance and exit openings being large enough to allow room for the inherent twist in the filamentary material to exit the exit opening without kinking; and a flange member surrounding the exit opening for engaging a panel of a container retaining the wound coil.

The payout tube may be constructed of corrugated fiber, pulp paper or plastic.

5 Claims, 5 Drawing Sheets

COMBINED FIBER CONTAINERS AND PAYOUT TUBES AND PLASTIC PAYOUT TUBES

BACKGROUND OF THE INVENTION

1. Related Applications

This application is related to application Ser. No. 09/063,278, now U.S. Pat. No. 5,978,812 entitled: "REELEX II Winding Coils with Large Payout Hole and Tube for Twistless Payout", filed Apr. 21, 1998 and assigned to the same assignee as the present invention. The subject matter of that application is incorporated herein by reference.

2. Field of the Invention

This invention relates to payout tubes for guiding filamentary material through a payout hole extending from the outer wind to the inner wind of a coil of filamentary material wound in a figure 8 wind, and in particular to such payout tubes made from corrugated fiber or plastic material and which have an oval, diamond, elliptical or round shape with an oversized opening to accommodate CAT 5, CAT 6 and CAT 7 cables for kinkless unwinding from the inner coil to the outer coil of the wound material. The invention is also useful in improving the payout of filamentary material other than CAT 5, CAT 6 and CAT 7. i.e. all filamentary material.

Some of the payout tubes are made of molded plastic, some are made of molded paper pulp and some are made of corrugated fiberboard.

3. Related Art

Payout tubes for performing the function of guiding filamentary material through payout holes in wound coils are known to the art. The structure of such payout tubes is represented by the following patents all of which are assigned to the same assignee as the present application, and wherein:

(1) U.S. Pat. No. 4,274,607 entitled "Guide Device for Use in Elongate Filament Dispensing Package and the Like" discloses a tubular guide device inserted radially into a payout hole in a wound coil and through a hole in a carton containing the wound coil and includes means for securing the guide device to the carton.

(2) U.S. Pat. No. 4,367,853 and entitled "Guide and Support Members for Unwinding Flexible Material from a Wound Package" discloses specially shaped cones adapted to extend into the inner opening of the payout tube to prevent tangles and birdnesting as the filamentary material is unwound from the coil.

(3) U.S. Pat. No. 4,057,203 entitled "Package of Flexible Material with Oval Payout Tube" discloses an oval shaped payout tube that is inserted in the normal diamond-shaped payout hole of the wound coil.

(4) U.S. Pat. No. 4,022,399 entitled "Screw-in Tube with Breakable Tabs for Coil of Flexible Material with Inner End Payout" discloses a payout tube with spaced flanges for engaging the wall of the container retaining the wound coil and with the opposite end of the payout tube from the flanges being inserted into the radial payout hole of the wound coil.

(5) U.S. Pat. No. 3,985,315 entitled "Package of Flexible Material for Twistless Payout with Wide Funnel Guide" discloses the outer end of the payout tube shaped as a funnel.

SUMMARY OF THE INVENTION

Notwithstanding the aforementioned advances in the state of the art of payout tubes the advances and development of new types of wire cable has generated a need for new types of payout tubes to enable the proper twistless payout of wound wire cable from the inner wind to the outer wind and through a radial opening between the inner and outer windings. In particular, the inherent residual twist characteristics of CAT 5, CAT 6 and CAT 7 cables require a much larger payout hole and payout tube to avoid kinking and interference with payout of the cable when wound in a figure 8 configuration and with a payout hole extending from the inner wind to the outer wind of the winding.

Furthermore, the present invention is related to application Ser. No. 09/063,278 now U.S. Pat. No. 5,979,812 as noted above. The assignee has designated the new winding system as a REELEX II package and the payout tubes in accordance with the present invention form part of the new REELEX II package.

In accordance with the REELEX II package many new products may be used with the assignee's patented and licensed REELEX system. Products which had been considered too stiff, too flexible, too hard, too soft, too easily damaged, too prone to tangling, too large, or too small for REELEX packaging will work well in the REELEX II package. For example, single conductors, ultra-flexible cable and fiber optic cables are now all usable with REELEX II packaging. The new REELEX II package also significantly improves cold weather payout performance of many cable constructions.

With the use of corrugated paper board or paper pulp payout tubes in lieu of plastic payout tubes both the container and the payout tube are recyclable and thus the REELEX II corrugated paperboard cable package will satisfy the stringent waste reduction requirements of today's job sites and European "green" packaging regulations.

Alternatively, the plastic tubes of the present invention may be used in the REELEX II package where such use is desired, such as with stiff, robust wire cables that would tend to damage corrugated paper materials.

It is therefore a primary object of the present invention to provide in a package of wound filamentary material of the type specified herein, a payout tube that is made of corrugated paper product, paper pulp or plastic.

It is a primary feature of the present invention that the payout tube is formed of corrugated paper as is the carton containing the wound coil.

It is an advantage of the present invention that the corrugated paper tube and the corrugated paper carton are recyclable.

It is another object of the present invention to provide an enlarged payout tube that engages with an enlarged payout hole to provide payout of wound flexible material having unusually stiff, flexible, hard, soft, prone to tangling, large or small characteristics.

It is another feature of the payout tube of the present invention that an enlarged payout tube provides kinkless and tangle-free unwinding of filamentary material from a wound package.

It is a further advantage of the payout tube of the present invention that wound flexible material having unusually stiff, flexible, hard, soft, prone to tangling, large or small characteristics may be unwound without tangling or kinking.

BRIEF DESCRIPTION OF THE DRAWINGS

The above objects, features and advantages of the invention are readily apparent from the following description of preferred embodiments of the invention when taken in consideration of the following drawings, wherein.

DETAILED DESCRIPTION

The payout tubes described herein are essentially made to function with the payout holes made in accordance with the aforementioned teachings set forth in the related patent application Ser. No. 063,278 now U.S. Pat. No. 5,979,812 and assigned to the same assignee as the present invention.

Figure 1:
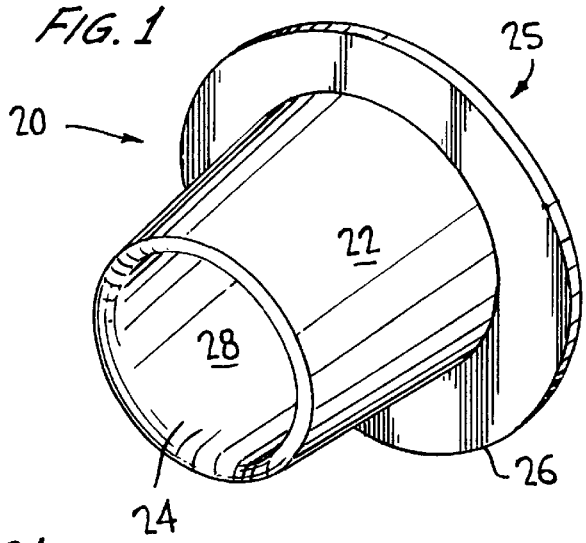
FIG. 1 is a perspective view of a payout tube in accordance with a first embodiment of the invention.

The payout tube 20 of FIG. 1 is preferably made of injection molded plastic or pulp paper and includes body 22, coaxial entrance opening 24 and exit opening 25. As illustrated in FIG. 1, entrance opening 24 and exit opening 25 are circular (see FIG. 3) as will be explained more fully hereinafter. The distance between entrance 24 and exit 25 openings may be varied as desired to accommodate different sized diameter windings. Flange 26 extends around the circumference of exit opening 25 to engage the side panel of a container holding the wound coil as is well known to those skilled in the art of payout technology. Payout tube 20 is made of injection molded plastic in accordance with well-known plastic molding, pulp paper or corrugated paper techniques. The body 22 of payout tube 20 narrows from the diameter of exit opening 25 to the diameter of entrance opening 24 as illustrated in FIG. 1.

Figure 2:
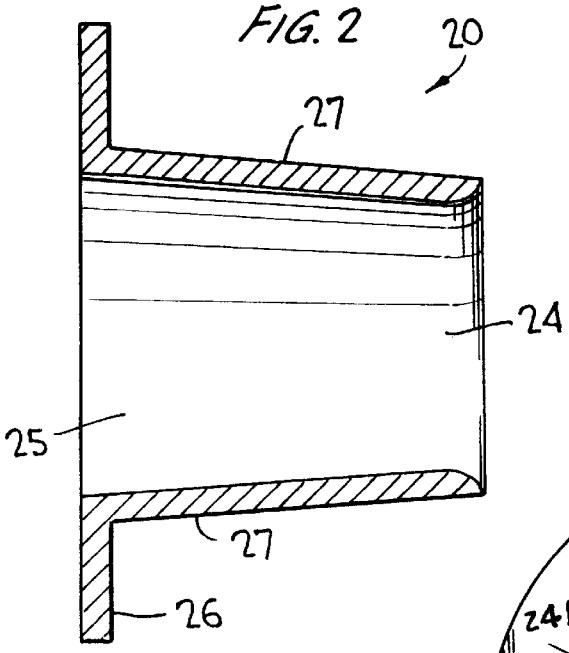
FIG. 2 is a side cross-sectional view of the payout tube of FIG. 1.

In the side view of the payout tube 20 shown in FIG. 2, the wall thickness of body 22 is approximately 0.04 inches for plastic tubes and ¼ inch for paper pulp tubes. The distance between the inside of entrance opening 24 and the outside of exit opening 25 is approximately 3.5 inches. The length of the payout tube 20 may be increased or decreased as necessary to accommodate the thickness of the wound coils with which the payout tube 20 is used. Flange 26 extends beyond the sides 27 of the payout tube 20 a sufficient amount to provide appropriate engagement of the flange with the side panel of the container (not shown).

Figure 3:
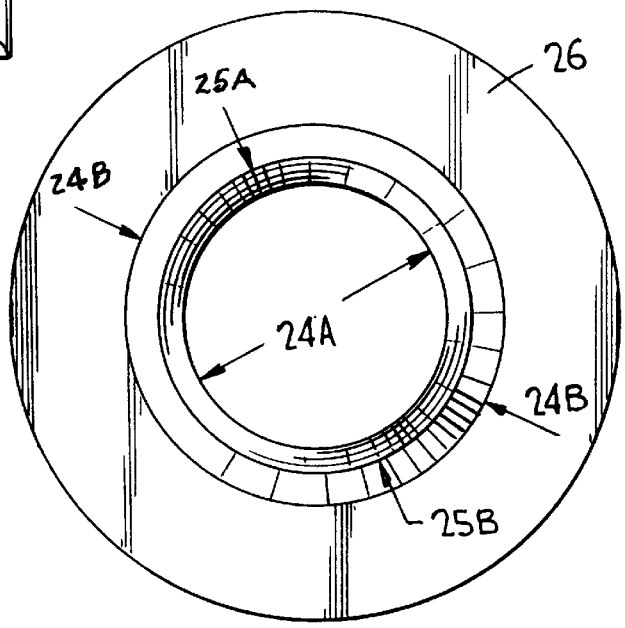
FIG. 3 is a view of the payout tube of FIG. 1 as seen from the exit opening side thereof.

FIG. 3 is a rear view of payout tube 20 (i.e. as viewed from the exit opening 24 end of payout tube 20) and shows the circular configuration of both the entrance 24 and exit 25 openings of the payout tube 20. The inner diameter 24A and outer diameter 24B of exit opening 24 differ by approximately 0.04 inches for plastic tubes and ¼ inch for paper pulp to provide suitable stiffness and ruggedness to accommodate stiff filamentary material. The inner diameter 25A and outer diameter 25B of exit opening 25 is also shown and preferably there is a difference of ½ inch in the respective diameters to provide a 0.04 inch for plastic tubes and ¼ inch thickness for pulp payout tubes of the body 22 of the payout tube 20. Exit opening 25 includes a flange portion 25B that rests against the outer surface of a container panel housing the wound coil (not shown) as is known to the art.

Entrance and exit openings 24 and 25 are sufficiently large to allow filamentary material wound in a configuration with a radial opening from the outer to the inner winds to be withdrawn from the inside of the coil and through the payout tube 20 without birdnesting or kinking. The configuration of the payout tube 20 in accordance with the invention essentially eliminates kinking and birdnesting of CAT 5, CAT 6 and CAT 7 cables and also improves the winding payout of all other filamentary material wound in accordance with the REELEX I and REELEX II techniques, for example as described in U.S. Pat. No. 4,406,419 for REELEX I and this application as well as application Ser. No. 09/063,278 now U.S. Pat. No. 5,979,812 for REELEX II techniques. For further explanation of the size of the openings to allow for kinkless payout, see application Ser. No. 09/063,278.

Figure 5:
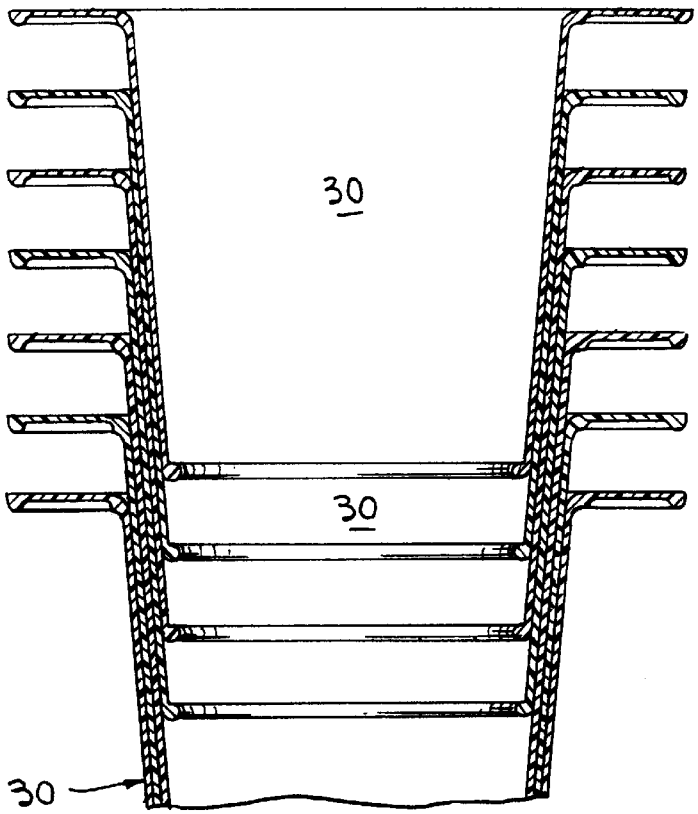
FIG. 5 is a cross-sectional view of a plurality of payout tubes of FIG. 4 shown in nested relationship.
Figure 4:
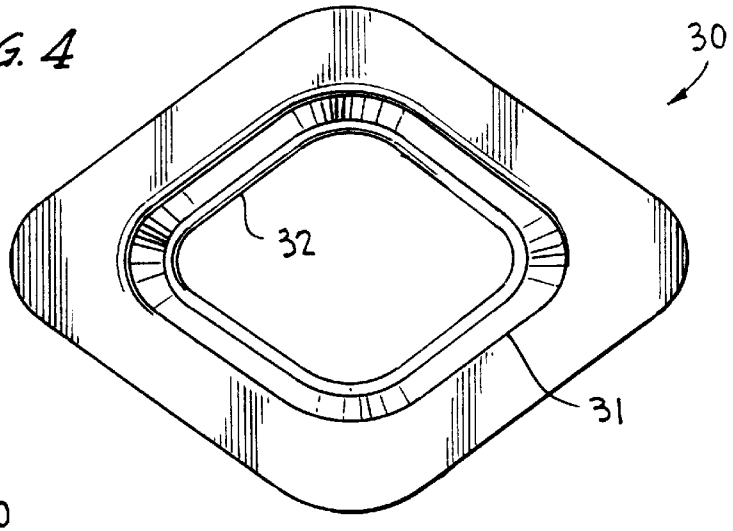
FIG. 4 is a front view of a second embodiment of a payout tube in accordance with the invention and made of plastic.
Figure 6:
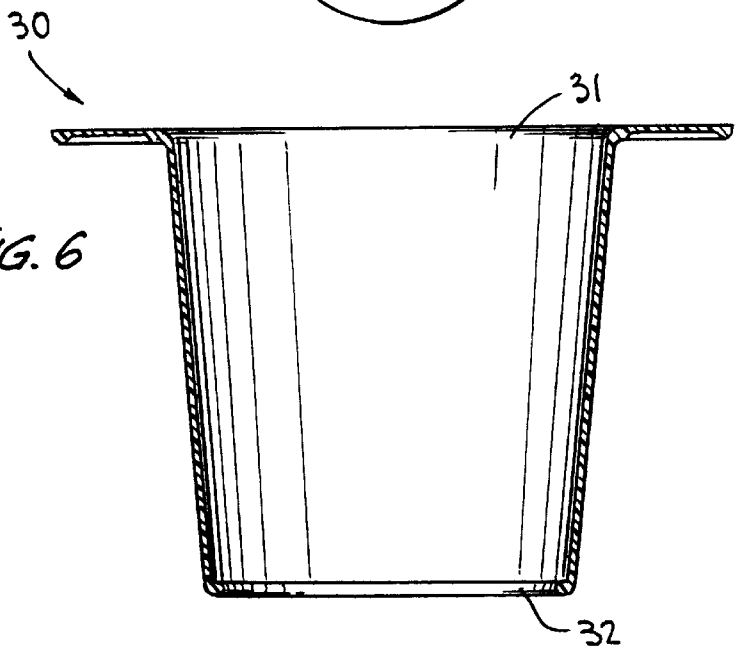
FIG. 6 is a cross-sectional view of the payout tube of FIG. 4.

FIGS. 4–6 illustrate another embodiment of the invention wherein the entrance and exit openings are oval in shape. In the top view of payout tube 30 the tube includes exit opening 31 and entrance opening 32, both in the form of a diamond, and wherein the dimensions of the two openings are as follows:

Width and length of the entrance opening are 2.49 and 1.77 inches, respectively; width and length of the exit diamond shaped opening are 5.06 and 3.66, respectively. FIG. 5 illustrates the manner in which the payout tubes 30 may be nested.

Figure 7:
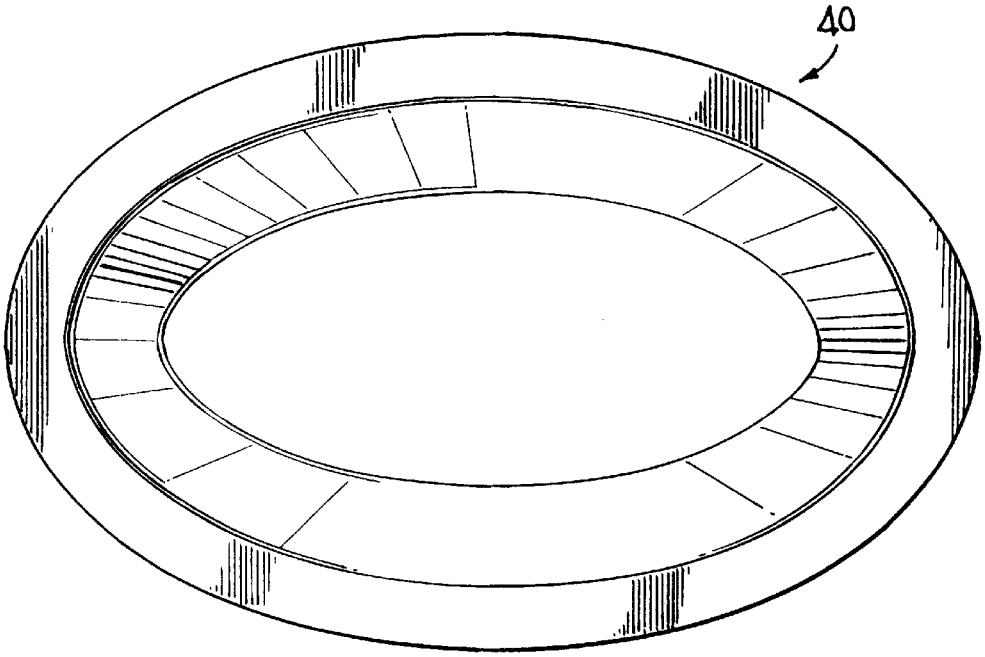
FIG. 7 is a front view of a third embodiment of the payout tube in accordance with the invention.
Figure 8:
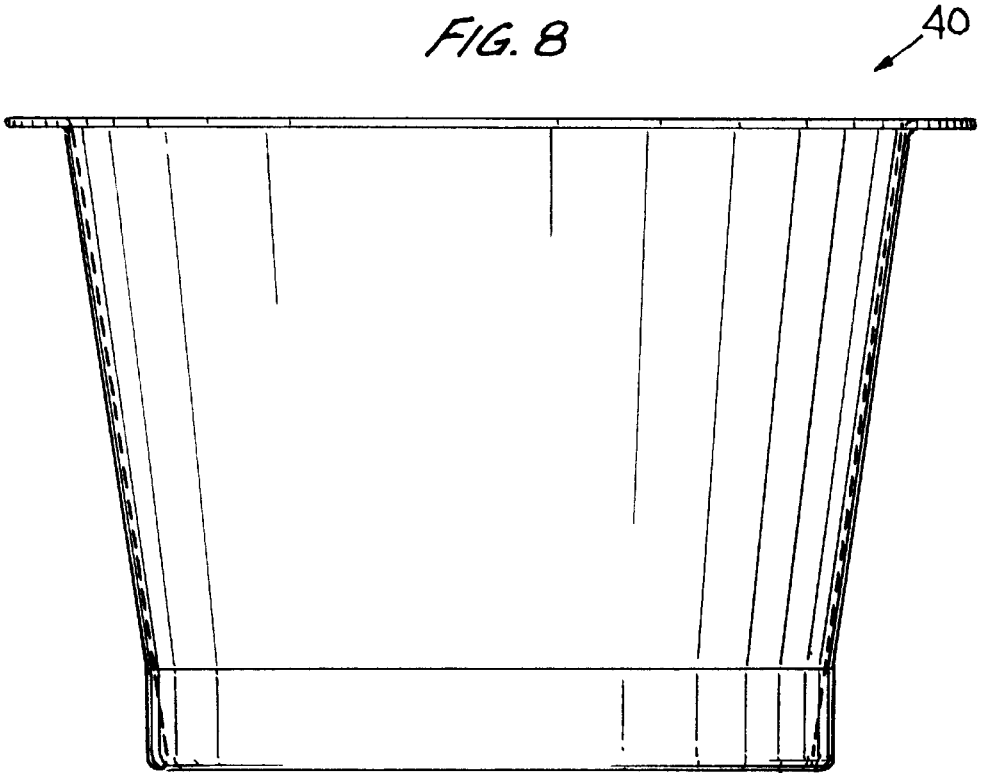
FIG. 8 is a side view of the third embodiment of the invention.

FIG. 7 simply illustrates an elliptical (football) shaped payout tube 40 and FIG. 9 shows a side view of the payout tube 40.

Figure 9B:
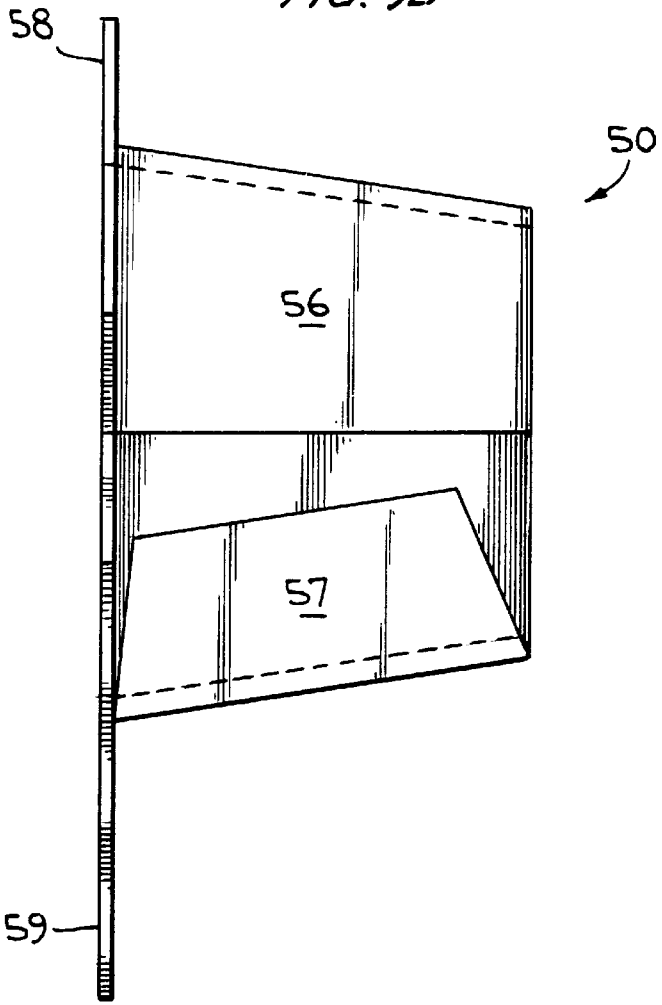
FIGS. 9A and 9B are respective front and side views of a fourth embodiment of the invention made from corrugated paper.
Figure 9A:
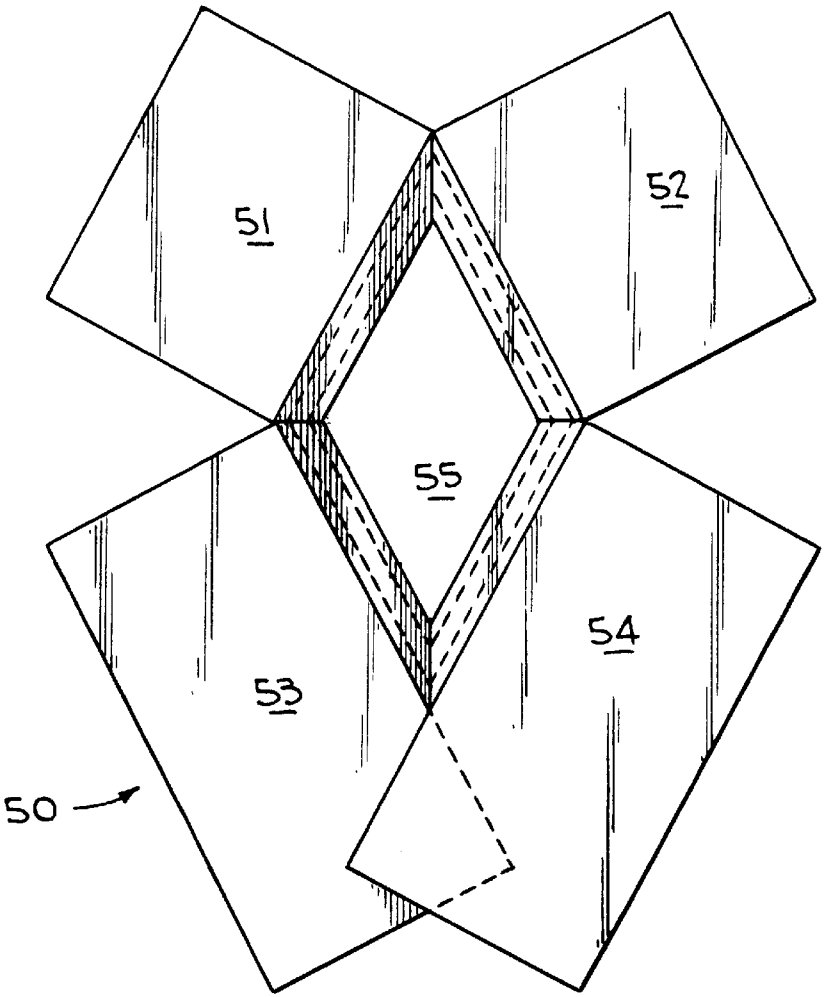

FIGS. 9A and 9B illustrates a payout tube 50 made of folded corrugated fiber and having a truncated shape as shown in FIG. 9B. Flaps 51, 52, 53 and 54 extending from the respective sides of the diamond-shaped exit opening 55 are folded to form the sides 56 and 57 of the payout tube 50. Flanges 58, 59 are formed by the folded flaps to engage the side panel of a container (not shown) to enable the payout tube 50 to remain in position with respect to the payout hole of the wound coil housed in the container.

The formation of the payout tube using corrugated fiber or other paper products provides a significant advantage with respect to the ecological disposal of the payout tube, for example as compared with a payout tube formed of plastic.

Figure 10A:
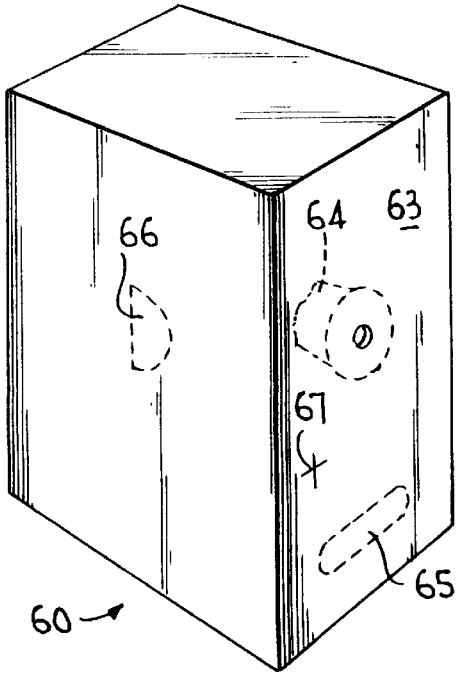
FIG. 10A is a cut-away perspective view of a fifth embodiment of the invention in which the payout tube and the container holding the wound coil are each made of corrugated paperboard.

A combined container and payout tube in accordance with a fourth embodiment of the invention is illustrated in FIG. 10A and shows container 60 for holding a wound coil of filamentary material (not shown) and including a payout hole extending from the inner coil to the outer coil and formed in accordance with the method disclosed in previously mentioned application Ser. No. 09/063,278 now U.S. Pat. No. 5,979,812. A serrated opening 62 is provided in panel 63 and is opened to allow the wound filamentary to be removed from the container 60. The filamentary material (not shown) is threaded through a payout tube 64 shown in phantom lines and which is incorporated as part of the container 60 as will be more fully described hereinafter.

Hand hold 65 enables container 60 to be carried from site to site. Semi-circularly-shaped cutout provides access to the interior of container 60 after it is assembled as is described more fully hereinafter with respect to FIG. 10B.

Container 60 is dimensioned in accordance with the diameter of the wound coil that is to be contained therein and may be manufactured in standard sizes to accommodate standard diameters of wound coils. For example, the container 60 shown in FIG. 10A may be 9.5 inches×13.5 inches to accommodate a 12 inch diameter wound coil. Opening 62 may be circular-shaped, diamond-shaped, or oval-shaped in conformance with the disclosure in application Ser. No. 09/063,278 now U.S. Pat. No. 5,979,812. Cross-shaped opening 67 enables the end of the filamentary material protruding from opening 62 to be inserted to prevent it from freely moving in a random manner and falling back into the container.

Figure 10B:
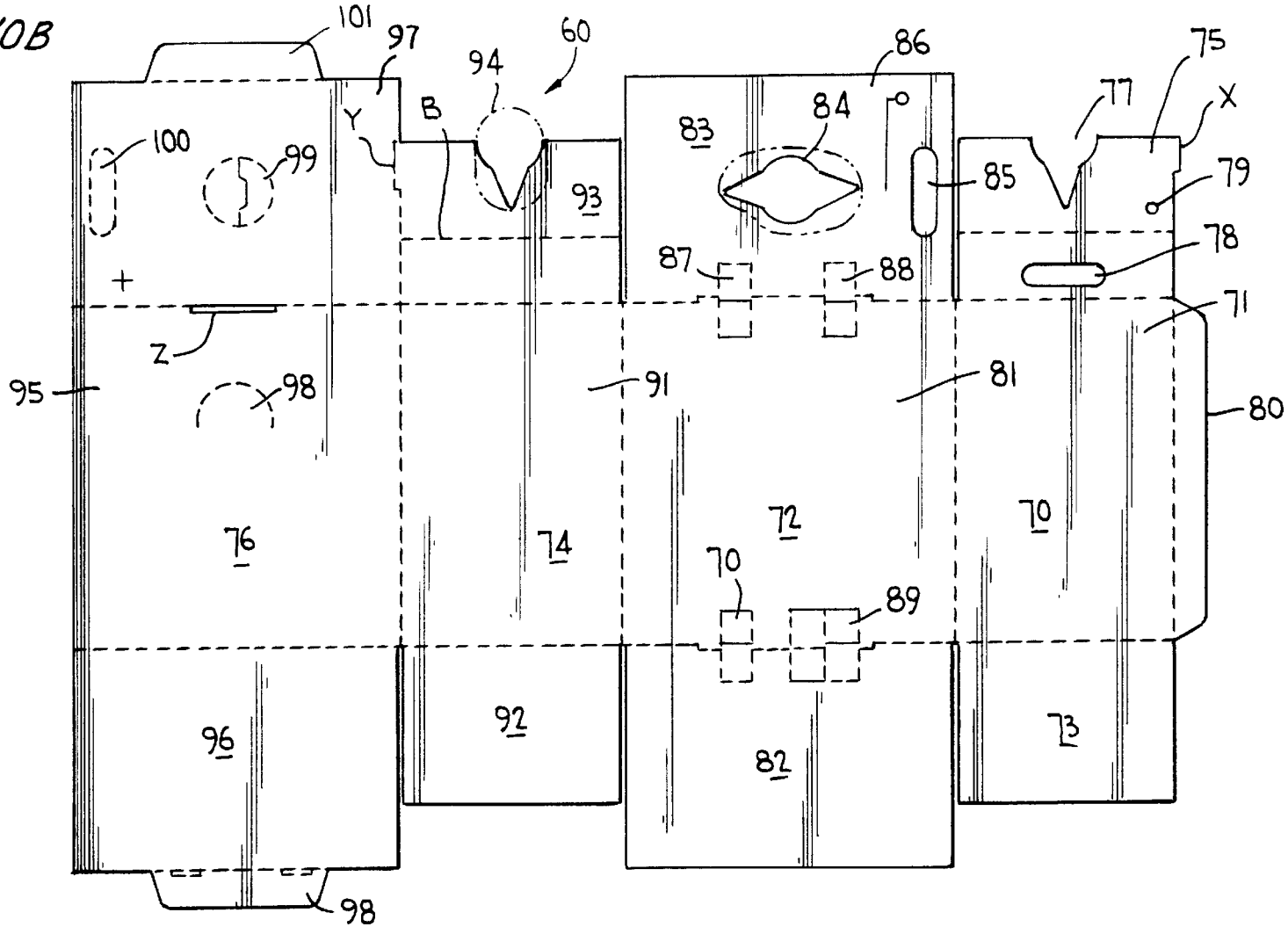
FIG. 10B illustrates a plan view of each of the respective sections of the corrugated paperboard forming the embodiment of FIG. 10A.

FIG. 10B shows a plan view of container 60 as it appears in unassembled form and consists of four sections, namely sections 70, 72, 74 and 76. First section 70 includes end panel 71, bottom panel 73 and top panel 75. Top panel 75 in turn includes V-shaped cutout 77 which forms part of a diamond-shaped payout tube to be more fully described hereinafter. Hand hold 78 enables the container 60 to be carried about as desired. Serrated hole 79 enables the end of the filamentary material of the wound coil to be inserted, thereby preventing it from moving freely. Flap 80 at the side of end panel 71 is a glue flap that connects panel sections 70 and 76 during the manual process that produces the box.

Second section 72 comprises side panel 81, bottom panel 82 and top panel 83. Top panel 82 includes a diamond-shaped payout tube opening 84, hand-hold 85, opening 86, which aligns with opening 79 in top panel 75. Flaps 87 and 88 in top panel 83 provide a means for securing top panel 83 with a counterpart top panel in fourth section 76 to be described more fully hereinafter. Flaps 89 and 90 in bottom panel 82 also aid in securing bottom panel 82 with a counterpart bottom panel in fourth section 76.

Third section 74 comprises an end panel 91, bottom panel 92 and top panel 93. Top panel 93 includes the other half of the diamond-shaped and round-shaped opening payout tube 94 formed along with V-shaped cutout 77 in top panel 75 when the various sections of the container are folded over during assembly.

Fourth section 76 includes side panel 95, bottom panel 96 and top panel 97. Side panel 95 includes port 98 which provides access to the wound coil when container 60 is assembled. Bottom panel 96 includes flap 98 for engaging a counterpart opening in the bottom panel 82. Top panel 97 includes serrated opening 99, which is aligned with payout tube opening 84 in top panel 83 when container 60 is assembled. Once the box is assembled serrated hand hold 100 aligns with hand-holds 78 and 85 providing three larger corrugated thicknesses and increased strength for carrying the container 60. Flap 101 engages a counterpart opening in top panel 83 when the container 60 is assembled by folding over the various sections described above.

The procedure for assembling the container 60 is as follows:

(1) The payout tube (round, diamond or oval-shaped) is inserted into the hole of the coil.

(2) The coil is then inserted into the box (after the bottom is made and the coil material is threaded through the guide tube).

(3) The flaps 75 and 93 are slid under the flange of the tube by bending the flaps at A and B. At this point a round tube will be held by the round portion of the cutout 77/94. A diamond will be held in place and in shape by the pointy area of the cutout 77/94. The side flaps 75 and 93 both have tabs (X & Y) that mate with slot Z. When these tabs are mated with the slot the two flaps prevent the tube from falling into the box when the coil is completely payed out.

(4) The flap 83 is folded over the tube, which helps hold the tube in place along with the top flap 97.

When the container 60 is assembled as shown in FIG. 10A, and as described above, with a wound coil of filamentary material enclosed therein, the end of the filamentary material (not shown) is unwound through the payout tube 71, 77, and 84 without kinking or birdnesting. The combined container and payout tube structure according to the invention provides a single structure for housing and paying out the wound filamentary material. The construction of the container 60 of corrugated paperboard makes the payout tube and the container recyclable.

In summary, the round paper pulp guide tube has a wall thickness of approximately ¼ inch and may be made in various lengths depending on the coil size with a 2½ inch entrance opening as illustrated in FIG. 1. The diamond-shaped (with round corners) paper pulp guide tube has a wall thickness of approximately ¼ inch and has the approximate dimensions as the diamond shape discussed in the above description. The paper pulp material has the distinct advantages of being biodegradable and recyclable. It is also the least expensive of the three materials disclosed herein and may be purchased close to any location where it is to be used, thereby significantly reducing transportation costs.

The round plastic guide tube has a wall thickness of approximately 0.04 inches, is biodegradable and has the advantage of stacking more efficiently than the pulp paper guides. This makes shipping costs lower, plus the other advantages mentioned in the above description. The advantage of the round tube over the diamond-shaped corrugated tube is that they tend to retain their shape once inserted into the payout hole. At most they may tend to become oval. However, the side flaps 75 and 93 (FIG. 10B) form a diamond shape opening once placed behind the flange of the guide tube and help to retain the diamond shape.

The above description serves only to describe exemplary embodiments of the best mode of making the combined fiber container and payout tubes and plastic payout tubes to demonstrate the features and advantages of its construction and operation. The invention is not intended to be limited thereby, as those skilled in the art to which the invention is directed will readily perceive modifications of the above-described embodiments. Thus the invention is intended to be limited only by the following claims and the equivalents to which the claimed components thereof are entitled.

What is claimed is:

1. A payout tube for insertion in a radial hole of a wound coil of filamentary material and extending from the inner to the outer wind of said wound coil, comprising:

said payout tube is made of folded corrugated fiber;

an entrance opening and an exit opening in coaxial and spaced relationship with one another;

the size of said entrance and exit openings being large enough to allow room for the inherent twist in the filamentary material to exit the exit opening without kinking; and a flange member surrounding the exit opening for engaging a panel of a container retaining the wound coil.

2. The payout tube of claim 1, wherein said entrance and exit openings are diagonal shaped.

3. The payout tube of claim 2, further comprising rectangularly-shaped flaps extending from each of the sides of the exit opening for engaging the side panel of a container housing the wound coil.

4. The payout tube of claim 3, wherein the length and width of the diamond shaped exit opening are 6.5 and 3.5 inches, respectively, and the length and width of the diamond shaped entrance opening are 4.5 and 2.5 inches, respectively.

5. The payout tube of claim 4, wherein the flaps extending from one pair of opposite sides of the diamond shaped exit opening are $3^{11}/_{16}\times3$ inches and the flaps extending from the other pair of opposite sides of the diamond shaped exit opening are $5^{11}/_{16}$ and 3 inches.

* * * * *